US007032821B2

(12) United States Patent
McClure et al.

(10) Patent No.: US 7,032,821 B2
(45) Date of Patent: Apr. 25, 2006

(54) PRECINCT VOTING SYSTEM

(75) Inventors: Neil L. McClure, Louisville, CO (US); Ralph David Wieland, Broomfield, CO (US); Victor L. Babbitt, Berthoud, CO (US); Robert A. Nichols, Thornton, CO (US)

(73) Assignee: Hart InterCivic, Inc., Austin, TX (US)

( * ) Notice: Subject to any disclaimer, the term of this patent is extended or adjusted under 35 U.S.C. 154(b) by 661 days.

(21) Appl. No.: 09/754,423

(22) Filed: Jan. 3, 2001

(65) Prior Publication Data

US 2001/0042005 A1 Nov. 15, 2001

Related U.S. Application Data

(60) Provisional application No. 60/186,030, filed on Mar. 1, 2000.

(51) Int. Cl.
*G07C 13/00* (2006.01)

(52) U.S. Cl. ..... 235/386; 705/12; 235/51

(58) Field of Classification Search ..... 707/104.1; 235/51–57, 386; 705/12; 704/104.1
See application file for complete search history.

(56) References Cited

U.S. PATENT DOCUMENTS 3,941,976 A * 3/1976 Huhn ..... 235/54 F
4,010,353 A * 3/1977 Moldovan et al. ..... 235/54 F
5,583,329 A * 12/1996 Davis et al. ..... 705/12
5,821,508 A * 10/1998 Willard ..... 235/51
6,178,338 B1 * 1/2001 Yamagishi et al. ..... 455/566
6,250,548 B1 * 6/2001 McClure et al. ..... 235/51
6,311,190 B1 * 10/2001 Bayer et al. ..... 707/104.1
6,550,675 B1 * 4/2003 Davis et al. ..... 235/386
6,873,966 B1 * 3/2005 Babbitt et al. ..... 705/12

* cited by examiner

*Primary Examiner*—Michael G. Lee
*Assistant Examiner*—Jamara A. Franklin
(74) *Attorney, Agent, or Firm*—Lathrop & Gage LC

(57) ABSTRACT

An electronic voting system includes a controller and one or more voting stations. The voting stations each have a liquid crystal display that is electronically configurable to present voters with ballot information. A mobile ballot box includes memory storage that is used to transport electronic ballot data to and from an election headquarters. The visual display on the LCD at the casting of each ballot is checked against electronic records of votes, as they are stored. The electronic ballot information includes a plurality of ballot styles that the controller selectively provides to the voting stations depending upon voter authorization corresponding to a particular style. The voting stations may be retrofitted with access units that facilitate voting by disabled or physically challenged persons. A complete audit trail is maintained of all operator interaction with the controller.

32 Claims, 5 Drawing Sheets

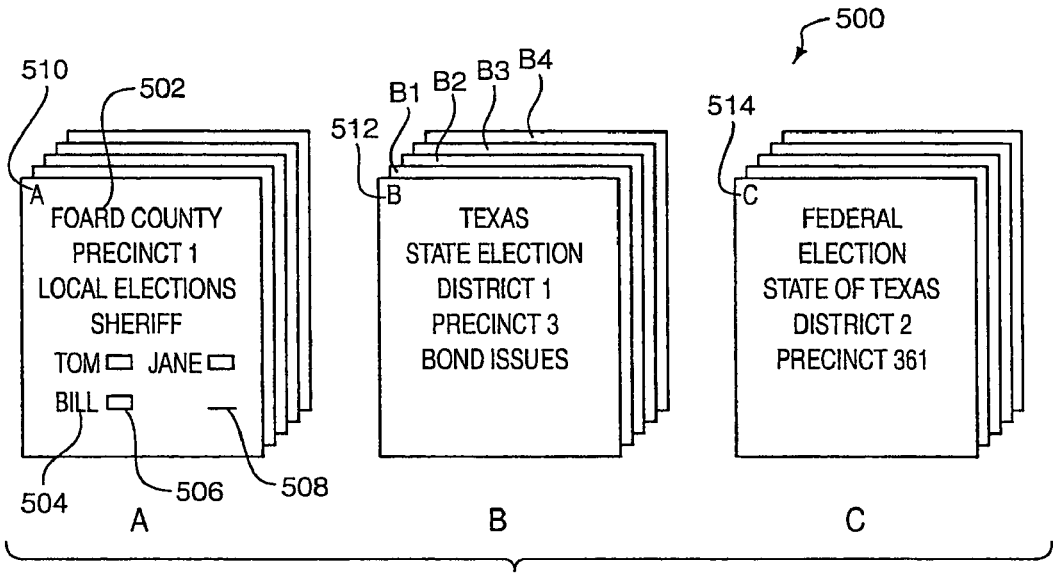
FIG. 5
FIG. 6
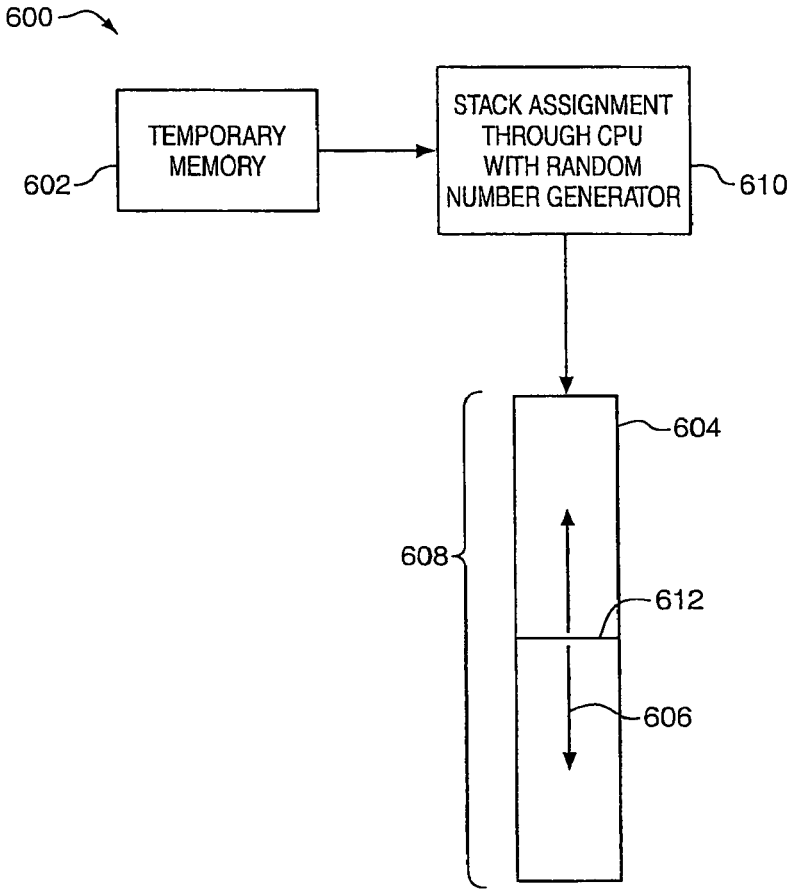

PRECINCT VOTING SYSTEM

RELATED APPLICATION

This application is a continuing application of provisional application Ser. No. 60/186,030 filed Mar. 1, 2000.

BACKGROUND OF THE INVENTION

1. Field of the Invention

The present invention pertains to the field of electronic voting system methodology, as well as apparatus for use in elections. More particularly, the voting system is improved to permit access for the disabled, with new methods for voters to navigate an electronic ballot, and to enhance the integrity of electronic voting processes by implementing advanced security and vote confirmation features.

2. Statement of the Problem

Modern elections are often performed on a large scale where information is collected from individual voters in numerous precincts, from the precincts to an election administrator, e.g., at a countywide or statewide level, and from respective states to the federal level. Due to the need for centralized planning and counting of votes, old systems including the counting of votes by hand from a ballot box are being discarded in favor of electronic voting systems.

As a consequence of this shift in voting technology, there have arisen significant concerns regarding the ability of computer-knowledgeable people to corrupt the election process. For example, a computer programmer might create a program having a user interface that masquerades as permitting the voter to cast votes according to a normal interactive process while the information that is collected from the voter is actually discarded. The system is then able to insert votes to be counted according to the programmer's desires.

Voting is intended to be a private matter where a voter can cast a ballot without fear of reprisals. Thus, the systems typically keep, and are often required by governmental authority to keep, no audit trail that can be traced back to the individual choices that a voter makes at the polls. This standard of anonymity exacerbates the difficulty in auditing the voting process to assure its integrity.

Everyone who is entitled to vote should be able to vote, but there are also situations presented to disabled voters that interfere with or prevent their voting. It is a significant challenge to develop a voter interface that permits disabled persons to vote while respecting their right to privacy.

New technology permits several systems to offer touch screen technology where the voters actually touch, with their finger on the stylus, an active screen element. The device responsively senses and records the selection. This type of voter interface presents the voter's selections at different locations on the screen, i.e., the voter must "hunt down" the proper area on the screen to make a selection. This type of activity slows down the voting process and increases the chance of the voter becoming lost or frustrated, thereby disenfranchising the voter. Furthermore, by presenting the voter with an active and fragile element of the voting device, this dramatically increases the possibility of device failure caused by voter abuse in the privacy of the voting booth.

U.S. Pat. No. 5,278,753 to Graft discloses an electronic voting system having an optical memory disk that is used to store election results. The disk may be hand carried between a precinct and a headquarters unit to assure, among other things, that the headquarters receives unadulterated election results. U.S. Pat. No. 5,758,325 to Lohry et al discloses a similar memory cartridge that contains a flash memory, as opposed to an optical disk. Electronic security means include password protection of operator control features and checksum handshake to verify the transportable memory cartridge. None of these references teach higher levels of security that prevent tampering with the election software itself and they each contemplate push button or touch screen ballot navigation.

SUMMARY OF THE INVENTION

The present invention overcomes the problems outlined above by providing a precinct voting system that operates as a direct recording electronic voting system and is designed to manage, conduct, and report on elections in a secure manner that also facilitates access by disabled persons. The precinct voting system is used for the precinct polling places and early voting sites.

The electronic voting system includes a controller that is configured with an interactive menu system permitting a poll worker to preside over an election. At least one voting station is coupled with the controller to form a network. The voting station has an electronically configurable display for presenting indicia representative of electronic ballot information to voters. A telecommunications link or nonvolatile memory storage device, e.g., flash memory, optical memory, magnetic memory or ferroelectric memory, is used to transfer electronic ballot information between an election administration station and the controller. The controller, in turn, disseminates selected portions of the electronic ballot information between the controller and the voting station to facilitate cooperable interaction between the controller, the voting station, and the electronically configurable display during the election. For example, the selected portions of the electronic ballot information may include ballot information that, in combination, comprises a ballot consisting of the elections in which the voter is eligible to vote.

The electronically configurable display at the voting station is preferably a liquid crystal display. A plurality of buttons and/or a rotary input device are used to navigate through the indicia on the display to present a voter with a ballot focus comprising a single selected ballot element. This ballot focus is preferably selected from the group consisting of darkened ballot elements, ballot elements having a changed font, and ballot elements having a changed color.

The electronic ballot information has a data structure that is preferably formed as a hierarchy of pages or elements comprising ballot choices. The mobile ballot box that contains this information preferably contains a plurality of different ballot styles, and the controller is capable of assigning a selected ballot style to a particular voter corresponding to eligibility of the voter to use a particular ballot style.

Reasonable precautions are taken to prevent software tampering in the nature of election fraud. A charge coupled device or information from the LCD controller is used to verify that indicia presented on the electronically configurable display matches votes being cast and stored as a voter concludes interaction with the voting station. This precaution assures that the votes being stored correspond to the image that is presented to the voter. Thus, it is either impossible or more difficult for a programmer to write a program that shows the voter the election choices but casts votes according to the programmer's wishes. Another precaution includes the storage of a complete ballot image of votes that are cast by each voter. This differs from prior practices that merely accumulate tallies. The storage of complete ballot images is randomized by a stack register system to prevent the cast ballots from being identified to a particular voter. The storage of all cast ballots is useful in case a programmer would attempt to write a plurality of identical ballots to storage by a program means other than actual cast votes. Furthermore, this manner of storage advantageously permits post election analyses of voter choices corresponding to statistical studies of voter groups having like choices on different issues.

The controller contains machine instructions permitting interactive configuration of the voting station prior to opening of polls for election purposes. The interactive configuration includes manipulation of user input devices by a poll worker in the voting stations as prompted by the controller.

The controller is provided with a lookup table, equation or random number generator for generating a voter access code. Each voter enters this code at the voting station to begin the voting process after the polls are opened. The voter access code is preferably unique on the system during the entirety of a single election. The voter access code is substantially dissimilar to other voter access codes that are concurrently assigned for use on the system to prevent voters from mistakenly entering an erroneous voter access code.

The voting station is selectively configured with a disabled access unit having an audio means for replicating the electronic ballot information. Input jacks are also provided for coupling with special controls for use by disabled or physically challenged persons.

Each voting station is preferably configured to operate on an automated RS-485 network termination circuit that permits separation of individual voting stations from the network without interruption of network operations. The automated RS-485 network termination circuit is modified to permit termination at each voting station without having a conventional manually installed network termination circuit installed in each voting station.

Another aspect of the invention pertains to a method of voting on an electronic network having a controller connected to a plurality of voting stations. The method comprising the steps of activating the voting stations; testing the voting stations for proper operation; opening the polls; generating access codes assigned to specific voters; activating a voting station for a particular voter according to the access code assigned to that voter; receiving a cast ballot through use of the voting station; and maintaining an audit log of all voting activities on the network while protecting voter anonymity.

The step of activating a voting station may be performed as a consequence of having the voter enter an access code at the voting station, where the controller assigns this code to the voter as the voter is authorized to vote using a particular ballot style. Voter Anonymity is protected while preserving a complete ballot image of the cast vote through use of a plurality of stack memory registers and a step of selecting the stack memory registers for storage of ballot image data in combination with a random number generator to assign storage locations identifying the cast ballot record or image.

The step of maintaining an audit log preferably includes recording any event that changes the state of the system with a time and date stamp, such as storing values representative of a time and date that each vote is cast. The audit log data is preferably stored in redundant nonvolatile memory, such as flash memory, optical data storage (e.g. a CD-ROM), or magnetic data storage. The redundant data storage may include a combination of each voting station recording events that have transpired at that voting station in combination with storage of the combined results of all voting stations at the network controller. The combined audit data on the network controller is preferably stored redundantly on multiple storage devices coupled with the network controller, e.g., in flash memory and in a detachable mobile memory unit.

It is particularly preferred that the system and method make use of a specialized vote recording device for use as a network component in casting ballots in the election. The vote-recording device comprises an electronically configurable display, such as a CRT, flat panel display, or LCD panel. Memory in the vote recording device, together with associated conventional video signal processing software and hardware, are used to receive the electronic ballot information from the network and process the electronic ballot information to configure the electronically configurable display for display of the electronic ballot information as text. A user input area includes a rotary input device for voter interaction as ballots are cast, and the cast ballots are transmitted back to the network. The rotary input device cooperates with the display to present a voter with a ballot focus comprising a single selected ballot element. The selected ballot element changes format for visual presentation to the voter when selected, e.g., by presenting a ballot element that differs form other element by virtue of being a darkened ballot elements, a ballot element having a changed font, or a ballot elements having a changed color. The electronic ballot information has a data structure that is formed as a hierarchy of pages, and navigation through the pages is controlled locally at the vote-recording device.

The vote recording device may be selectively configured with a disabled access unit, which preferably includes a text to audio converter together with special controls for physically challenged persons. The device may be connected with other similar devices to form a network, and the network is preferably configured to operate on an automated RS-485 network termination circuit permitting separation of individual voting stations from LCD DREs without interruption of network operations. A charge-coupled device may be used to verify that the votes being cast are, in fact, the votes that are presented for visual display to the voter.

BRIEF DESCRIPTION OF THE DRAWINGS

FIG. 5 depicts a page layout data structure for electronic ballots;

FIG. 6 depicts a random dual stack memory configuration that is used to store cast ballot information in a manner that protects voter anonymity.

DETAILED DESCRIPTION OF THE PREFERRED EMBODIMENT

Figure 1:
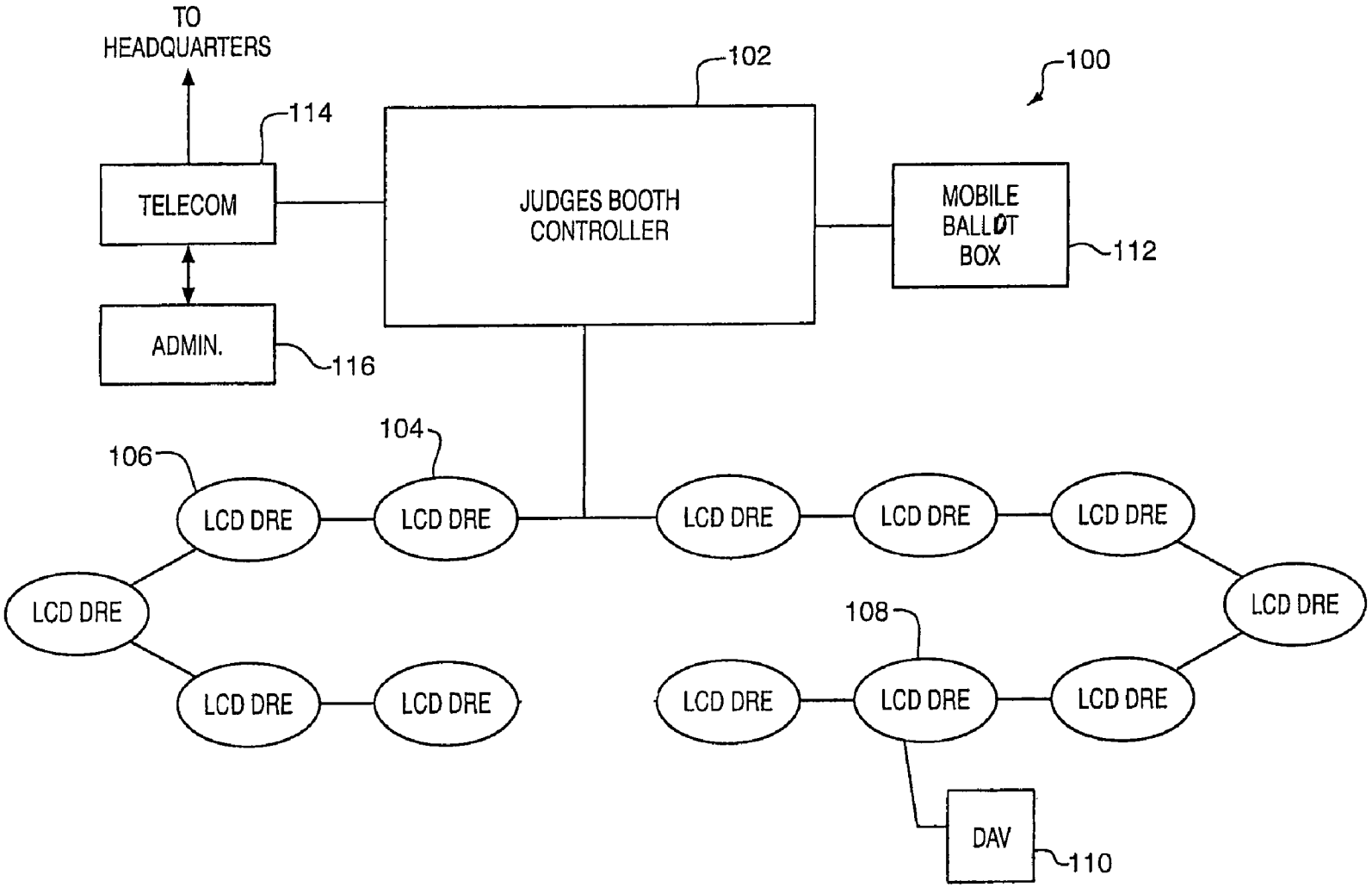
FIG. 1 is a conceptual diagram showing the structure of a precinct voting system according to the present invention.

FIG. 1 depicts a precinct voting system 100 according to the present invention. The precinct voting system is distributed from a central location either to geographical precincts or to early voting sites. A central location, or headquarters, corresponds to the main offices of the jurisdiction. The precincts are election districts that are divided geographically according to population and jurisdictional boundaries. Early voting sites are selected geographical locations within a jurisdiction that support the complete election and allow voters from any precinct to cast their vote.

The networked precinct voting system 100 is made up of a controller, which is called the judge's booth controller (JBC) 102, and multiple voter-input devices that are called the liquid crystal display direct recording electronic voting devices (LCD DRE), e.g., devices 104, 106 and 108. FIG. 1 depicts the precinct voting system 100 as having the LCD DREs formed in a daisy chain of sequentially connected devices forming a line, however, it is also possible for the LCD DREs to branch and/or form loops. A disabled access unit (DAU) 110 is a direct recording electronic voting device that that is specially configured for access by disabled persons, e.g., persons who are visually, physically, or hearing impaired. A mobile ballot box 112 is used to provide the precinct voting system 100 with any data that is relevant to the election, and the mobile ballot box 112 is also used to carry election results back to election headquarters. The mobile ballot box 112 is used to store multiple ballot images representing the various ballot styles that may be used in an election and operates according to principles that are described in copending application Ser. No. 08/953,003, which is incorporated by reference to the same extent as though fully disclosed herein. The paragraphs below provide additional detail for each of these systems.

Additional equipment preferably includes a secure dedicated telecommunications connection 114 that establishes communications with election headquarters or an election administration station 116. The election administration station is preferably used to manage or facilitate elections in a plurality of precincts and normally resides in a physical location that is geographically removed from the physical location of the precinct where voting occurs.

Judges Booth Controller (JBC)

The JBC 102 is a stand-alone device located at each precinct-polling place. Each JBC 102 preferably controls from one to twelve LCD DREs.

Figure 2:
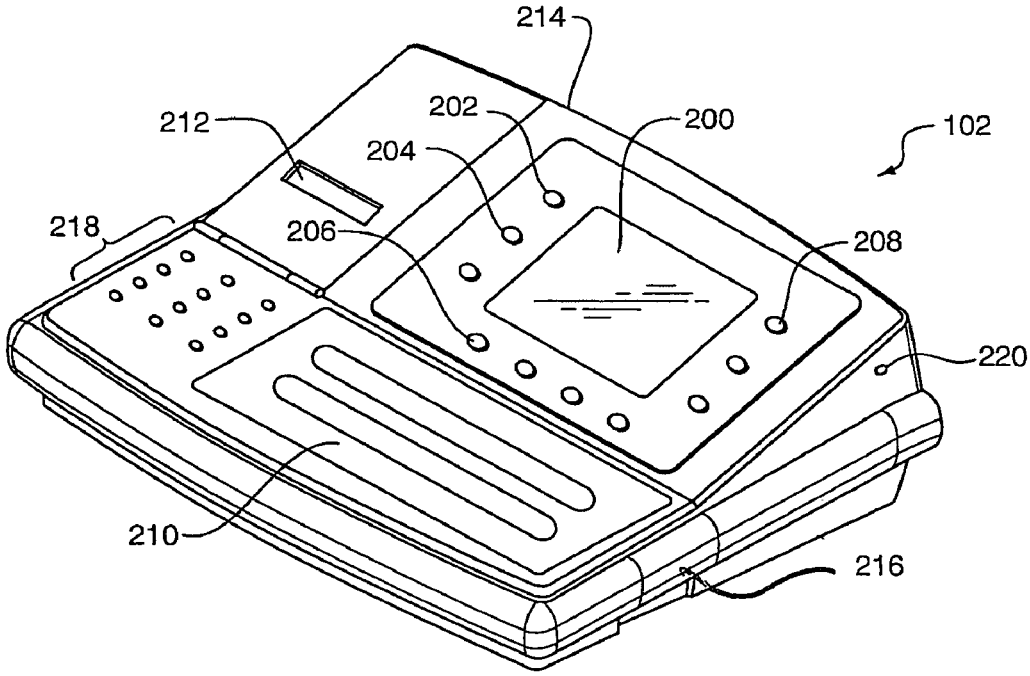
FIG. 2 is a diagram providing additional detail with respect to a judge's booth controller that is also shown in FIG. 1.

FIG. 2 shows preferred features for each JBC 102. A display 200 is used to deliver instructions and messages to an operator in charge of operating the precinct voting system 100 for election purposes. A plurality of selection buttons, e.g., softkeys 202, 204, and 208 are configured by software to permit the operator to make selections, as prompted by software internal to JBC 102. The function of each button may change according to program specifications. Alternatively, some keys, e.g., key 206, may be provided with dedicated functions that do not change. An alphanumeric keypad 210 permits the operator to enter precinct names, ballot styles and other data. The internal structure of JBC 102 has internal memory storage that provides a complete audit trail of all events or keystrokes entered by the operator. A built-in printer 212 is used for printing ballot access codes, test results, election results (if required) and audit trail information. The rear 214 of JBC 102 contains an appropriate set of connectors as required to connect to the first voting station 104, main power, and a serial port for external modem for the telecommunications connection 114. A slot 216 to insert a portable a mobile memory device that functions as a mobile ballot box, e.g., a FLASH, magnetic or optical memory device. A plurality of 12 status lights 218 are used to indicate the state of each connected LCD DRE.

Liquid Crystal Display Direct Recording Devices (LCD DRE)

Figure 3:
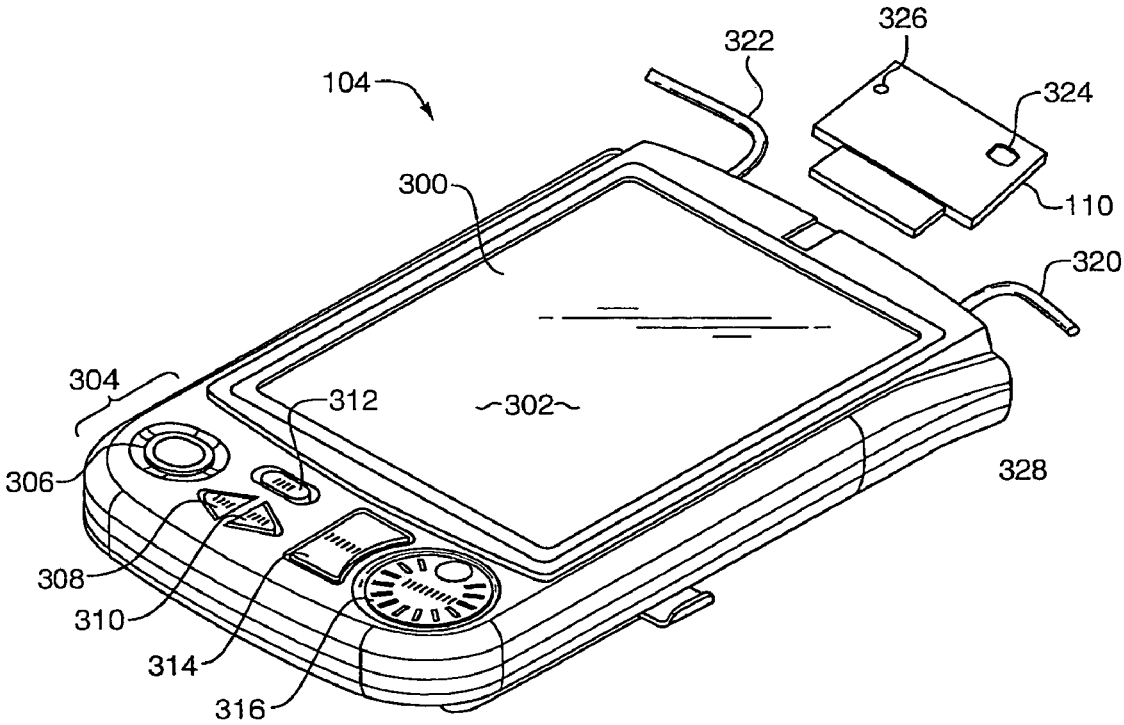
FIG. 3 is a diagram providing additional detail with respect to an LCD DRE that is also shown in FIG. 1.

FIG. 3 shows a LCD DRE 104, which is used for voting, presenting the ballot to the voting public and accepting voter selections. The LCD DRE is the primary tool for direct voter interaction, and it has the following preferred features. A liquid crystal display (LCD) 300 is used in portrait mode with a protective shield 302 installed to prevent vandalism or abuse of the underlying LCD 300. A user input area 304 includes a set of push buttons 306, 308, 310, 312, and 314, as well as a rotary input device 316. The buttons are used to navigate the ballot by directing motion of the cursor of ballot focus, e.g., as through use of left-right arrow buttons 308 and 310, an enter button 314 that is used to select the object of the ballot focus, and buttons 306 and 312 which may be used to page through electronic page presentations of the total ballot or to tab through sequential selections. The LCD 300 is configured with a charge-coupled device (CCD) for electronic reading of the images that are displayed on the LCD 300. These images include information that the voter has entered, as well as codes that identify a particular ballot page that JBC 102 causes to be displayed on LCD 300. Thus, a comparison may be obtained between the sensed values from the actual display and values that have been transmitted to a buffer or data file representing choices that the voter has made. This comparison confirms that the votes being cast correspond to the ballot images that are presented to the voter.

The rear 318 of LCD DRE 104 contains an appropriate connector for receiving a cable 320 from the JBC 102 or a previous LCD DRE. There is also an attached cable 322 for connecting to the next LCD DRE in series. The LCD DREs are connected "serially", one connected to another, so there is only one cable attached to the JBC. Each LCD DRE 104 contains an automated RS-485 termination circuit, which permits the separation of individual LCD DREs without interruption of network operations. This feature is particularly useful during the performance of an election when, for example, maintenance must be performed on one of the LCD DREs during an election. According to the RS-485 protocol, an LCD DRE having this termination circuit can be selectively coupled and uncoupled from the system 100 without interruption of system operations. The rear 318 also contains a cavity or port that is compatible with an optional disable access unit or DAU 110.

Disabled Access Unit (DAU)

The DAU 110 is an optional device that can be included in the LCD DRE. The DAU provides from a headphone audio jack 324 an audio output for "reading" the ballot to a disabled voter through headphones. A remote switch input jack 326 is used to connect special switches and the like that are easier for disabled persons to use than the switches on input area 304. For example, a quadriplegic would not be able to operate the push buttons 306, 308, 310, 312, and 314, or the rotary input device 316, but jack 326 may be connected to controls that are similar to those of a wheelchair that is specially design for quadriplegics to operate. Similarly, jack 326 may be connected to controls that have special input devices for the disabled, such as accessible switches that facilitate use by those with severe forms of cerebral palsy or other motor function disabilities. A slot 328 is provided to insert a FLASH memory card containing audio data for use in combination with DAU 110.

Mobile Ballot Box

A reusable, portable FLASH memory device, the mobile ballot box 112 is used for storing election information. The mobile ballot box 112 is the primary means for transporting information between an election headquarters or election administration station the polling places including the precinct voting system 100. The reusable mobile ballot box 112 and can have data stored to it many different times. FLASH memory does not require batteries to maintain the data written to it. The electronic ballot data that is stored in mobile ballot box 112 includes all possible ballot styles for the jurisdiction, a list of polling places and the allowable ballot styles for each polling place, ballot format information for display on the LCD DRE, a list of serial numbers, both public and private for allowable LCD DREs and JBCs, and passwords as required to verify and authorize operator functions as required for purposes of operating system 100. These features make the mobile ballot box generic to any precinct, i.e., the ballot box is not specific to any particular geographic location or voting site.

Power Outage

The precinct voting system 100 is impervious to power outage or brownout conditions. The system is designed and tested such that no data is lost in the event of any power interruption or discontinuity. When power is restored to an operational system, software causes a recovery to the same operational state that existed before the power failure. For example, if power is cycled when polls are closed, the system will recover to the polls closed state.

As most power outages last less than two minutes and batteries are expensive to maintain and manage, back-up batteries are not a standard feature for preferred embodiments of the precinct voting system 100. However, the JBC 102 does have an Auxiliary DC (AUX DC) input 220 (see FIG. 2) that accepts from 12 to 24 VDC and will operate the entire precinct voting system 100. A back-up battery or other DC source may be connected to this input and operate under this condition for any length of time. Should circumstances require back-up battery support for a specified length of time, the charge capacity of the battery is determined by defining the number of LCD DREs to be connected then adding up the known power consumption.

Each voting station may also accept sufficient batteries, e.g., eight D-cells, to permit operation of the system based upon a combined system power emanating from each voting station. Only half of these batteries are needed to operate the system, which permits renewal or replacement of used batteries while the system is in operation during an election. Thus, the weight of the batteries, which may comprise seventy pounds or more for a single precinct that requires twenty-four volts at seventy-five amp hours, is distributed across the entire system. This distributed weight permits the system to more easily comply with regulatory or practical weight limits for safe handling of equipment.

Automatic Network Termination

The communication protocol used for the precinct voting system 100 is a non-standard RS-485, which requires that the first and last node of the network be terminated. The system 100 network is composed of one JBC 102 and from one to twelve LCD DREs 104–108. The JBC 102 connects to the first LCD DRE and the first LCD DRE may then be connected to one or more additional LCD DREs in a daisy-chained manner. Since the RS-485 network requires the first and last node to be terminated, a means has been devised to automatically terminate the RS-485 network on the last LCD DRE that is connected to the network. This permits optional termination and reestablishment of the RS-485 protocol as required for purposes of the election in step P436 and for support of curbside voting.

In the normal daisy-chained network configuration that is shown in FIG. 1, the JBC 102 supplies power to all of the LCD DREs on the network. Each LCD DRE supplies power to the next LCD DRE. Since each LCD DRE supplies power to the next LCD DRE, each LCD DRE can determine if it is the last LCD DRE connected by sensing the current flow to the next LCD DRE. If the LCD DRE senses no current flow, then it is the last LCD DRE on the network and activates an electronic switch to terminate the RS-485 network.

This manner of automatic termination is also useful as part of the network configuration step P402 in setting up the precinct voting system prior to the election. The number of LCD DREs that are used in any one location will constantly vary. Having the network automatically terminate, no matter how many LCD DREs are connected, eliminates the need for a non-technical poll worker to remember to physically connect a termination device on the last unit. Leaving the conventional termination device off of the RS-485 network yields inconsistent and unreliable communication and, consequently, absence of the termination device is difficult to detect. Automatic termination as described above eliminates this problem.

Figure 7:
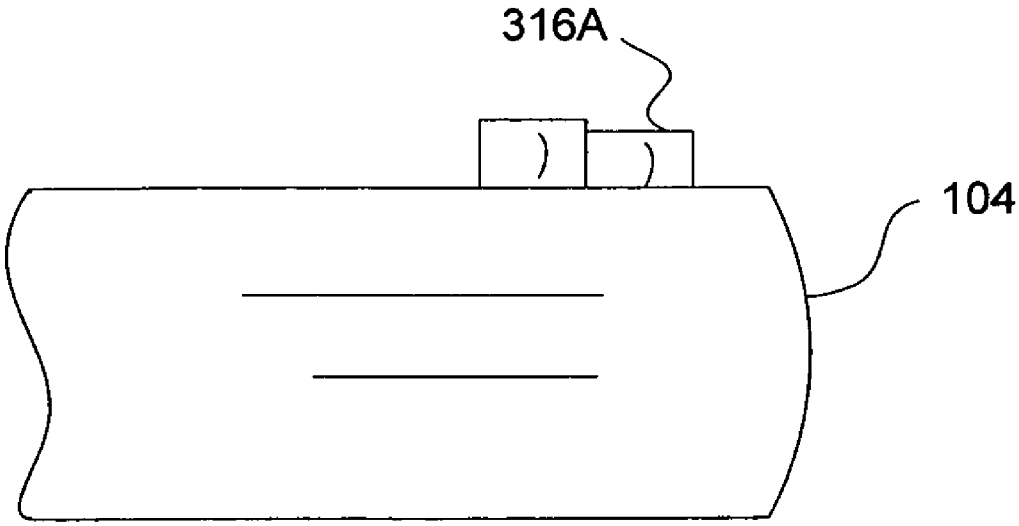
FIG. 7 is a partial real elevational view of a voting station showing an alternative rotary input device.

FIG. 7 is a partial rear elevational view of voting station 104 showing an alternative rotary input device 316. Rotary input device 316A differs from rotary input device 316 shown in FIG. 3 because the rotary input device 316A is rotated 90° with respect to rotary input device 316. Rotary input device3 316A is, otherwise, identical to rotary input device 316.

Figure 8:
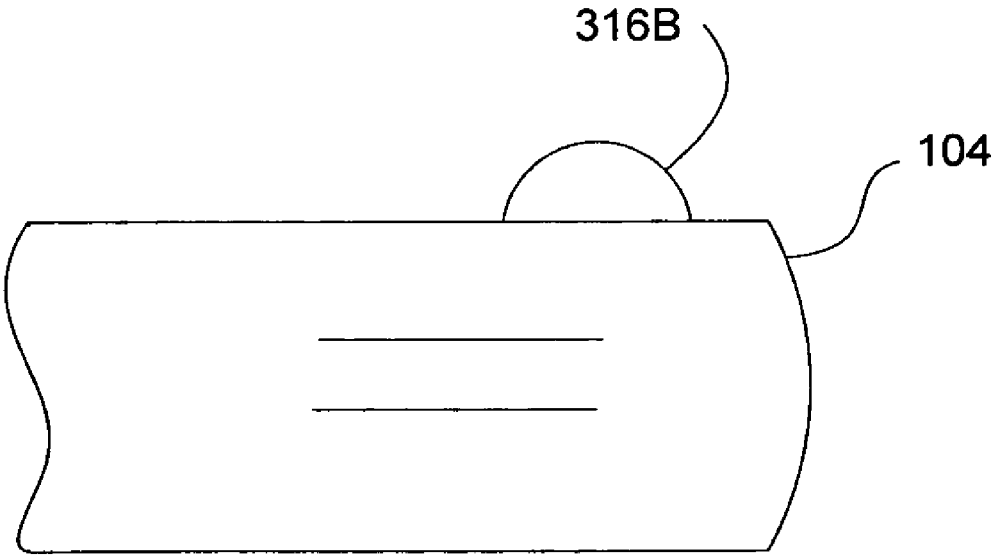
FIG. 8 is a partial real elevational view of a voting station showing yet another alternative rotary input device.

FIG. 8 is a partial rear elevational view of voting station 104 showing an alternative rotary input device 316B. The rotary input device 316B is a track-ball device providing infinite control of the cursor or ballot focus on screen 300 that is used to select ballot elements and a sequential progression through the respective ballot elements and menu options of screen 300 is not required.

System Operation

Figure 4:
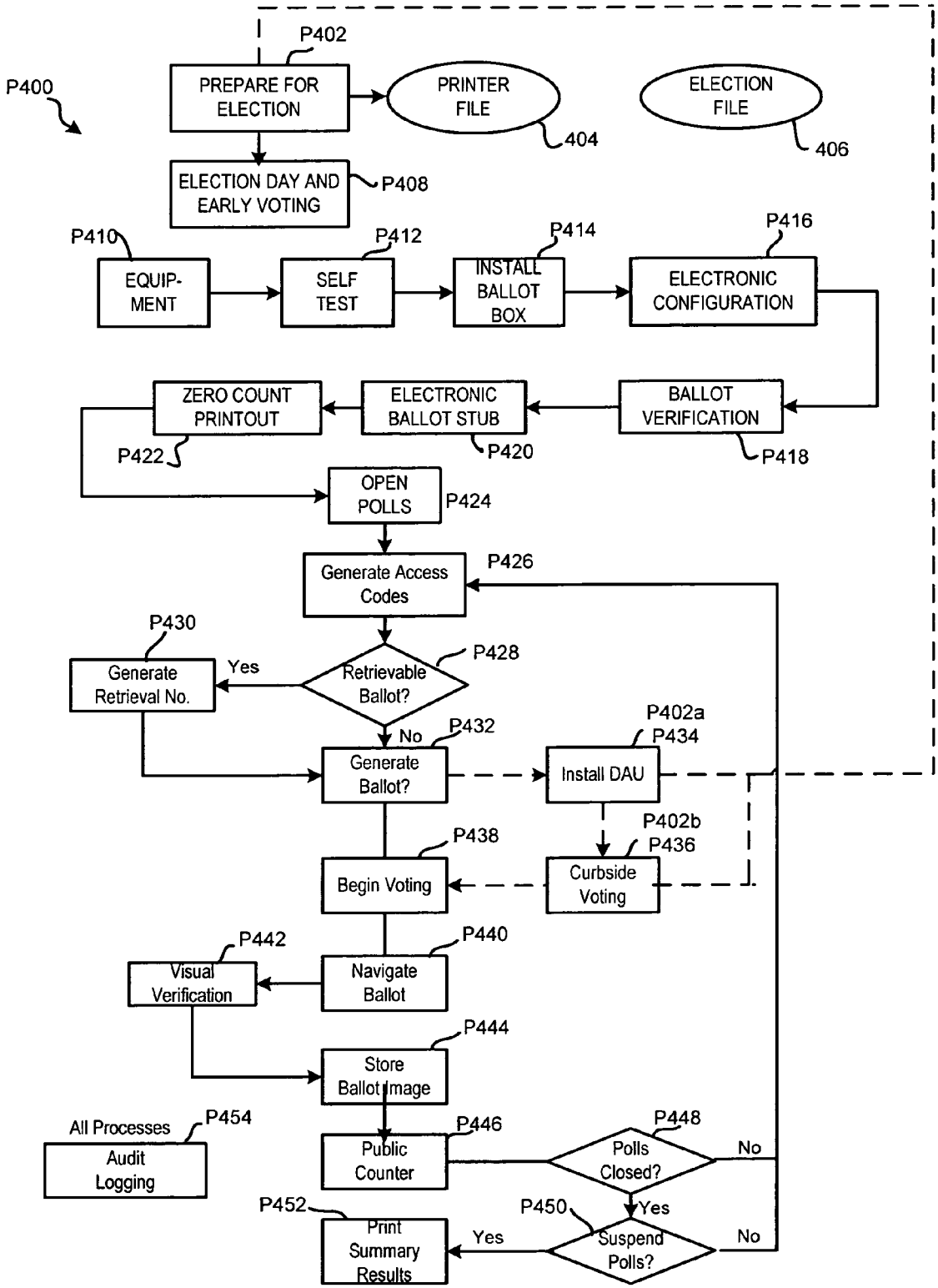
FIG. 4 is a process schematic diagram showing the operation of the precinct voting system.

FIG. 4 is a schematic diagram of process P400 showing the operation of precinct voting system 100. The process P400 is controlled by the JBC 102, which has internal memory and a CPU that is programmed with machine instructions or program logic for purposes of accomplishing the process steps. JBC 102 interacts with the LCD DREs, the mobile ballot box 112, and the election administration station 116, as well as other elements of precinct voting system 100, which may also be programmed with complimentary machine instructions to accomplish the process steps.

Step P402 entails preparing for the election. Personnel or computers at the election administration station 116 lay out ballots such that the election subject matter is in an organized, readable fashion. The ballots adhere to the jurisdiction's legal requirements. The election administration station produces each ballot style in two formats. The first format is essentially a printer file 404 that allows each individual ballot to be printed on a laser printer and/or displayed on a computer monitor or other display device.

These ballots can be used for absentee voting or as check ballots to verify the proper content of each style.

The second ballot format is an electronic form 406 that is preferably a single file and is called the electronic ballot data. The election administration station produces each ballot style in an efficient data format to minimize the required memory space. A single file is generated and contains all the information necessary to support the election from any geographic location. This file is called the electronic ballot data and is written to the mobile ballot box 112 for use by the precinct voting system. The election administration station 116 downloads the electronic ballot data to the mobile ballot box, which is then hand-carried for installation in the JBC 102. Alternatively, the ballot information may be transmitted from the election administration station 116 to the JBC 102 by use of the secure telecommunications link 114 and confirmed by reverse transmission.

The mobile ballot box 112 is the primary link between the JBC and the election administration station 116 with the telecommunications connection 114 being a backup. The mobile ballot box may be installed in the JBC at election headquarters or at the precinct-polling place to accomplish step P402. For any particular election, a large number of different ballots are required to address the different eligibility of voters within a jurisdiction. The different ballots are referred to as ballot styles and are differentiated by the contests and races that each style contains. The electronic ballot data represents all possible ballot styles for a particular election. With all possible ballot styles in the mobile ballot box, all precinct hardware becomes generic so that any JBC, mobile ballot box or LCD DREs may be used at any location in a particular election. Thus, there is no need to control distribution of these items from the election administration station 116 to remote precincts. Additional details concerning the mobile ballot box may be found in copending application Ser. No. 08/953,003, which is hereby incorporated by reference to the same extent as though fully disclosed herein.

FIG. 5 is a graphical reference to the electronic ballot data 500 according to step P402. Each ballot style A, B, or C that is contained in the electronic ballot data 500 is stored as a series of references to a set of pages, e.g., B1, B2, B3, and B4. Each page represents the amount of data that can be displayed on a single screen of the LCD DRE. Each page also consists of a series of references, e.g., fields 502, 504, and 506, that point to the actual information that is to be displayed. Typically, a large amount of the information to be displayed to the voter is repeated in each ballot style and by using references, the actual displayed information is only stored once in the electronic ballot data. This reference method greatly reduces the amount of memory that is required to store the electronic ballot data. The integrity of the ballot is maintained by storing these linked references on a page by page basis.

The actual information that is displayed to the voter is divided into several different data types depending on what the information is intended to communicate to the voter and what type of action the voter may perform on the data. Each data type, or ballot element, is unique and is based on control information that is used for navigation, triggering other events and links to other ballot elements. Attached to the control information are drawing instructions that define what and how the information represented by the ballot element is to be displayed. For example, race titles are differentiated from race candidates. Race titles are typically displayed in a different font, do not have an associated selection box (e.g., box 506) and, if selected, will navigate the voter to the next race.

Individual ballot styles A, B, and C consist of a defined hierarchy of ballot elements. The foundation of the hierarchical structure is the control information necessary to establish links in the structure. Additional control information is used to manage navigation through the hierarchy. From a practical standpoint, the voting process would be slow and cumbersome if navigation through the ballot was limited to linear methods and the present hierarchical structure does not have such limitations. Control information contained in the ballot elements allows for non-linear, or three-dimensional travel through the hierarchy to speed up the ability to move from one Ballot Element to the next.

Navigation of the ballot can be thought of as a cursor 508 moving through the ballot structure and the position of the cursor is called the active ballot element. The screen progression through the ballot is presented to the voter in a linear fashion for ease of use, with the hierarchical data driving the display Each ballot page includes a ballot page code 510, 512, or 514 that uniquely identifies the page. These ballot page codes may be alphanumeric, a bar code or some other method used to uniquely identify a single sample from a larger sample set. The ballot page code is graphically displayed on the LCD DRE, and is located in the same defined location each page. When the page is displayed on the LCD DRE, the ballot page code is part of the output.

Election Day and Early Voting

According to step P408 (see FIG. 4), election day and early voting processes use the same processes except when closing the polls. The polling process begins with a pre-election sequence including steps P410 through P422 leading into the polls open operation of step P424. Once voting is complete, the polls are closed and the collected information is prepared for transport back to headquarters. The sequence of pre-election operations is performed semi-automatically by the JBC and the LCD DREs.

The pre-election operations include equipment setup in step P410 where the LCD DREs 104–108, JBC 102, mobile ballot box 112, and privacy enclosure are either delivered or are brought to the precinct by the poll workers. The JBC 102 is the host for a serial-connected network preferably consisting of the JBC and one (1) to twelve (12) LCD DREs. The first LCD DRE is connected to the JBC with the next LCD DREs connected to the first. This connectivity continues with up to twelve LCD DREs to daisy-chain the LCD DREs to one another by a single cable that carries both power and data. The JBC 102 is able to communicate to each of the LCD DREs individually. The cable connections are made from the back of the devices to allow routing the cables out of traffic areas and not accessible to voters.

A power-on self-test is performed in step P412. AC power is supplied to the JBC 102 by a conventional power cord plugged into the wall outlet. This can be done before or after the LCD DREs are connected to the JBC 102. There is preferably no on/off switch on the JBC 102. Once the power cord is plugged in, the JBC immediately starts the power on self-test. The single cable that connects the JBC 102 and LCD DREs carries both communication data and power. Once the LCD DREs are connected to the JBC 102 they likewise begin their power on self-test simultaneously.

In each case, the power-on self-test automatically performs an internal check. The memory is given an extensive test to make sure that it is operating correctly. Writing information to various components and reading back the response verifies the general operation of the circuitry.

The mobile ballot box is installed and verified in step P414. Once the power-on self-test is successfully completed, the JBC checks for the presence of a mobile ballot box 112, which may be installed at headquarters or at the polling place. If the mobile ballot box 112 is installed, the JBC 102 moves into verification mode, i.e., to verify the mobile ballot box 112 by an electronic handshake, a hidden stored value, re-calculation of cycle redundancy checks (CRC's) or digital signatures. If the mobile ballot box 112 is not installed, the JBC prompts the poll worker to install it. The mobile ballot box is inserted in a slot 216 on the side of the JBC 102 that is covered by a hinged door that snaps closed. Once the mobile ballot box 112 is installed and the door is closed, an optional security seal may be installed to prevent removal. Once JBC 102 has detected the mobile ballot box 112, the firmware resident in the JBC 102 is verified as being the correct revision by comparing to a value stored in the mobile ballot box. 112. After verification of the mobile ballot box 112 and the firmware of JBC 102, the JBC 102 copies information from the mobile ballot box 112 into memory and causes the mobile ballot box to be specific to that particular location or voting site. The JBC 102 reads the electronic ballot data 500 on the mobile ballot box 112 and verifies that the mobile ballot box 112 contains the proper data. The precinct voting system 100 is now ready to be configured for polling.

Step P416 includes the electronic configuration of the precinct voting system 100 and is required to establish communication between the JBC 102 and each of the LCD DREs 104–108. Once configured, the JBC 102 controls the network communication traffic by polling each connected LCD DRE and by responding to a request to transmit data to each LCD DRE. The configuration process essentially allows the LCD DREs to become a slave-node on the network comprising precinct voting system 100. The JBC 102 must authorize the presence of each LCD DRE and allow it to communicate on the network. The following events occur by operator response during the network electronic configuration:

Enter precinct identifier: The poll worker is required to enter the precinct identifier or early voting location identifier using the alphanumeric keypad on the JBC 102. This entry causes the equipment to become location specific for the duration of the election.

LCD DRE button test: The poll worker is required to physically enter each voting station, which includes a combination of a LCD DREs and a privacy enclosure. The poll worker is prompted to activate each of buttons 306–314 and turn the wheel 316 to verify proper operation of the user interface in area 304. The LCD DRE screen 300 displays a response to each button or wheel activation.

Detect LCD DREs: The order in which the poll worker enters each voting station determines the order in which the voting station set-up will be referenced. The first station activated is identified as station 1. The second station activation establishes station 2, etc. This assignment of order is for convenience only. Once the poll worker activates all of the buttons 306–314, the screen 300 displays a new message stating that the station will be assigned the next station number. The poll worker is required to press the "ENTER" button 314 on the LCD DRE and that action causes a corresponding signal to be sent to the JBC 102. This signal notifies the JBC 102 that a device wants to be acknowledged and added to the network. The JBC 102 records data specific to that LCD DRE, e.g., an electronic serial number, and authenticates the data to verify the LCD DRE.

Once the network is configured in step P416, JBC 102 prompts the poll worker to perform an optional ballot verification in step P418. There are two methods to verify proper ballot configuration in the precinct including manual and automatic methods According to the manual ballot verification process, before the polls are open in step P424, the poll workers are permitted to display each ballot to verify proper operation, formatting and sequence of pages. Any of the connected LCD DREs can be used for the verification against printed check ballots. Approval of the verified ballot is done by pressing the ENTER key on the keypad of the LCD DRE when in manual ballot verification mode. The printed check ballots P404 that are produced at the headquarters in step P402 are used as a comparison for visual and logical accuracy.

Alternatively, the JBC 102 and each LCD DRE can perform an automatic verification of ballots for logical accuracy. When placed by the poll worker in the automatic verification mode, the JBC 102 arms the connected LCD DREs with each ballot style. Each LCD DRE then proceeds automatically through each page of the ballot for verification. As each page is displayed on the LCD, the ballot page code is read off the screen by the CCD and recorded. Once all pages for the ballot style have been displayed, the charge coupled device on each LCD DRE reads and transmits to JBC 102 the ballot page codes that are read for that ballot style as it is displayed on the LCD DRE screen 300. These codes that have been read by the charge coupled device are called an electronic ballot stub. The JBC 102 then compares the ballot page codes with a corresponding listing that is stored in the electronic ballot data to verify that the correct image is displayed on the LCD DRE. If a mismatch occurs, the JBC 102 alerts the operator with an error message displayed on the JBC screen 300.

The ability to read the ballot page code from each ballot page and save the codes in conjunction with the ballot style provides a novel method to audit the election process. As with automatic verification, once the polls are open and voters are casting their ballots, the LCD DRE is able to keep a record of which ballot pages a voter votes on for their assigned ballot style. Thus, the concept of an electronic ballot stub applies to captured images corresponding to each ballot that is cast.

Step P422 accomplishes the remaining task prior to opening of the polls in step P424. This task is to produce a "zero count" printout from the memory locations where ballot images are to be stored. The JBC 102 verifies that the ballot image sectors in the storage memory are blank and the public counters are set to zero in preparation for saving cast ballot images during the election. The JBC printer 212 outputs a report that details the state of the ballot storage memory.

Opening the Polls

Only after the pre-election procedures of steps P410–P422 are complete does the JBC display the option to open the polls in step P424. The JBC 102 guides the poll worker through the open polls process, as described below. The poll worker selects "Open Polls" and then JBC 102 prompts the poll worker for a password or access code. The poll worker uses the alphanumeric keypad 210 to enter a unique open polls password for the precinct-polling place. Verification of the operator code is performed by the JBC

102 using information supplied in the mobile ballot box 112. With entry of this code, the polls open and the JBC 102 booth status lights 218 are each green indicating that each connected LCD DRE is "Available.".

The Polling Process After Polls Open

The voting sequence begins with each voter presenting the necessary identification to a poll worker for validation of eligibility. The poll worker looks up the voter's name, which has an alphanumeric ballot style or precinct number associated with it. The ballot style or precinct number can be entered directly by the poll worker or can be selected from a list provided by the JBC 102 through a series of interactive menu screens. Once the ballot style number is entered, the JBC 102 responds with an access code, which is preferably a random 4-digit string. This access code is displayed on the JBC screen 200 and printed by the JBC printer 210. The print out is torn off and given to the voter to complete step P426. The voter now moves to the next available booth with the access code.

The 4-digit access code allows a voter access to a single ballot of the appropriate style. A single polling place system having up to twelve LCD DREs will accommodate up to 10,000 voters in one day, so each voter may receive a unique code (0000 to 9999). The number must be "random" to prevent a voter from guessing the next number in the sequence to cast an unauthorized ballot. Sequentially issued codes must also be as dissimilar as possible over a reasonable time for casting votes to prevent a voter from accidentally entering another voter's code. For example, if two codes, 1234 and 1235 were assigned and active at the same time, it would require only one missed key (4 to 5) for the voter-owner of code 1234 to enter an incorrect code that is, nonetheless, a valid code. Finally, the technique that is employed to generate these values must be sufficiently memory efficient to allow for implementation on an embedded system with limited resources.

In the present invention, voter access codes are generated using a virtual lookup table with 10,000 unique values. The first voter code is selected by starting at a random index into the table. Subsequent codes are selected by taking a consecutive value from the table. This provides a random starting point every time the system is initialized. The virtual lookup table is constructed by first generating a table of 100 two-digit values with each column of values as unique and dissimilar as possible.

Each digit is used a minimum number of times to make the column of numbers unique and dissimilar. A column of two-digit numbers can be generated where each digit from 0–9 is only used twice. For example, the digit zero (0) would appear only in "90" and "02", and even then, with a different significance. This two-digit number selected from the table is used for the lower two digits of the four-digit code. A 4-digit number is formed by using the two-digit number selected from the table as the row and column number of the virtual table to select the upper two digits. So for example, if the first two digits are 90, then the upper digits are formed from column "9" and row "0". Looking up the value in the virtual table may yield "80", for example. Thus the complete and unique number is "8090". A sequence of 10,000 numbers can be formed using this method. Below is an example of ten consecutive numbers generated by this method, which numbers can be seen by inspection to be unique and dissimilar from one another.

| Index/Voter Code | | | | |
|---|---|---|---|---|
| 0000/8090 | 0002/4814 | 0004/0538 | 0006/5251 | 0008/1975 |
| 0001/1402 | 0003/7126 | 0005/2749 | 0007/8663 | 0009/4387 |

The implementation of this approach is ideal for limited memory environments. Memory requirements may be further reduced by implementing the table of 100 values as an equation to eliminate the need for any fixed look up table. Furthermore, by using different constants in the equation, different virtual tables can be created. At start-up, one of one hundred different equations is selected randomly and then the starting point, or index, within the virtual table is randomly selected. This compound randomization gives essentially an infinite possibility as to what number is generated for the access codes and the corresponding sequence in which they are generated.

Another benefit to this approach is that a "reverse" operation can be performed to obtain the table index from the voter code value. A reference to the equation selected at start-up is saved in non-volatile memory along with each access code that has been issued. Following a power failure, using the equation reference and the last access code issued, the reverse operation is use to restore the index so that no repeat Access Codes are issued.

This approach to access code generation provides security because the pattern will not repeat itself within a single election and, therefore, is difficult to guess. The beginning index point and equation used changes with each election so that no sequence of issuing codes can be determined. An equation that may be used to assign the numbers may be varied by the simple precaution of changing coefficients. Even if the approach is discovered, the sequence would be difficult to determine without knowing the exact equation that is used to generate the virtual table of 100 two-digit numbers. Finally, even if the code generation process is defeated, little damage could be done with the ascertained knowledge because the election judge must still assign the number one at a time.

The access code is valid for a time period set by the election administration station 116, typically 30 minutes, after it has been issued to the voter. Once a voter uses an access code, it cannot be re-used in an election because the JBC 102 invalidates all used codes when votes are electronically cast.

Retrievable Ballots For Contested Voters

The precinct voting system 100 supports access for contested voters according to step P428. Most states provide for a voter's right to vote to be contested at the polling place at the time when a voter prepares to cast their ballot. In most cases, the voter is allowed to vote and a determination as to voter eligibility is made after some investigation following the close of the polls. In this circumstance, the voter must cast a retrievable ballot so the ballot is not counted in the event that voter eligibility is denied.

The poll worker assigns a retrievable ballot by selecting a menu option that is provided on the "Assign Access Code" screen from the JBC 102 in step P428. By selecting this option, the JBC printer 212 outputs a report that includes a Retrieval Number and space for the voter to record his or her name and signature. Included in this report are details about the election, the location, time and date. The poll worker retains the report after the voter has signed it. In step P430, the voter is assigned an access code for the retrievable ballot screen, e.g., by the same processes that are used to generate the access code in step P426. As in step P426, the voter is given an Access Code report that is used to cast a ballot. At this point, a Retrieval Number has been set up so that when the voter enters the Access Code, the Retrieval Number will be attached to the ballot image when the ballot is cast. The Retrieval Number may later be used to adjust the election totals according to actual eligibility of the voter once it has been confirmed.

Step P432 entails the generation of a ballot for use by the voter at a voting station, such as the LCD DRE's 104 and 106 (see FIG. 1). The ballot is preferably selected from a plurality of ballot styles that may be provided to the precinct voting system from the election headquarters either by telecommunications linkage 114 or the mobile ballot box 112. In preferred embodiments, the voter is permitted to review only those election in which the voter is eligible to vote, and this ballot style is selected from a predetermined array of ballot styles or ballot components that are created in advance of the election.

Disabled Accessibility

The disabled access units (DAU) are typically configured as part of step P402, e.g., 402*a*, such that each polling location has one or two LCD DRE's equipped with a disabled access unit, depending upon the demographics of the location. The DAU's can, however, be moved to another LCD DRE in the field, if required. By virtue of a poll worker installing the optional DAU 110 in step P402*a* or P434, the associated LCD DRE supports the ability of physically challenged voters to cast a secret and private vote. The optional DAU 110 preferably fits into a corresponding cavity in the rear of the LCD DRE that hides the DAU 110 from view when the DAU 110 is installed. The DAU 110 can be factory installed or an LCD DRE can be upgraded in the field. Once installed in an LCD DRE, the DAU 110 will typically not be moved to another LCD DRE unless the host LCD DRE becomes defective.

As discussed above, the preferred DAU 110 has an accessible slot for a PCMCIA memory card and two audio-style jacks. The memory card is preferably installed at headquarters or the voting administration station 1116 and stores audio wave files that are equivalent to the textual content of all the ballot styles that are stored on the mobile ballot box. The two audio-style jacks are for headphones and accessible switches, which are used to interface with the ballot. The audio wave files may also be downloaded from the mobile ballot box 112.

A disabled voter is authorized to vote in the same manner as are other voters. Disable voters are directed or led to an available LCD DRE that is equipped with a DAU 110. Further assistance at this point is dependent on the degree of disability and the desires of the voter. Disabled voters may require assistance entering their Access Code, locating and fitting of the headphones, orientation with the user interface and accessible switches. Once these preliminary steps are completed the voter is able to vote unassisted.

Ballot navigation is accomplished in the same manner as by other voters. The user interface is active and operates in the same visual manner with emphasis upon the ballot focus. However, for a voter with a visual impairment, including blindness, the combined LCD DRE DAU 110 provides an audio equivalent of the ballot text. When the Ballot Focus changes to a new Ballot Element, the text displayed is "read" to the voter and heard through the headphones. Control information as part of the Ballot Element carries with it an audio tag that when a DAU is present, triggers a look-up for the audio equivalent. The stored wave files are a natural recorded voice so the voter hears the text in clear, comprehensible manner. When Select is rotated to the next Ballot Element, the voter hears the next selection. When the voter presses Enter, the audio informs them of their selection and jumps to the next race. At the next race, the race title is heard, with instructions to press Enter to skip to the next race without voting in the present race. This process continues until the ballot is completed.

For a physically challenged or disabled voter, accessible switches may be used in place of the buttons and wheel in user input area 304. Accessible switches include flat, push button momentary switches that are about 2½" in diameter and are standard devices used for accessibility. Other accessible switches are supported, such as "sip & puff" switches, "head switches", and the like. The input jack is an industry standard that may be used with any type of conventional accessible switch. Two accessible switches are typically used, one for Select and the other for Enter. As previously stated, the entire ballot may be navigated and cast using only these two inputs. The audio output may be used in conjunction with the accessible switches providing greater versatility in support of the wide range of possible disabilities.

In the preferred embodiment, the user interface will consist of black text on a white background. This coloring schema permits visually disabled persons including color-blind people, i.e., people with achromatopsia, and partially sighted voters such as those having eyesight that has degraded with age, to view the presented text in the highest possible contrast. Any color graphics are preferably in pure shades of yellow and green. Spectral blue and spectral red are preferably not used together because the combined use of blue and red causes many older voters to constantly refocus between the two different colors. This refocusing results in a fuzzy image or stereopsis, which is an effect in which some letters seem farther away than others.

Additional preferred features that enhance visual clarity for most voters include the presentation of text in a positive polarity, namely, dark text on a light background, as opposed to light text on a dark background. Viewing angle standards are based upon a statistical sampling of voter height, and it is preferred to use a viewing angle that affords acceptable viewing contrast to most voters, e.g. those having heights ranging from 95% of all standing males to 50% of all seated females. Acceptable contrast limits may vary under different lighting and voter heights, as defined in industry standard documents, such as ISO/DIS 13406-2 "Ergonomic Requirements For Visual Display Units Based on Flat Panels-Part 2: Requirements for Flat Panel Displays, " International Organization for Standardization, (1997), which is hereby incorporated by reference to the same extent as though fully disclosed herein. The display luminance preferably ranges from 250 to 750 lux. The minimum viewing distance is preferably 400 mm, except for soft touch screens where the distance is 300 mm.

Curbside Voting

One or more of the LCD DRE or LCD DRE DAU unit(s) from a precinct voting system 100 can be designated for curbside voting in an optional step P436 or P402*b*. The designated unit may be temporarily detached from the network to allow voting at a nearby location, such as parking space near the entrance to the polling place. The unit may be detached following entry of the access code and ballot download, but it must be re-connected to transmit the ballot image to the JBC 102. A series of ballots and access codes may be transmitted at once when the LCD DRE is eventually reconnected to the network.

After the ballot or ballots have downloaded to the LCD DRE, the unit may be disconnected from the network. Two key features make this possible. First, the DAU equipped LCD DRE has internal storage capacity for eight (8) D-cell batteries and power will automatically switch over when the cable from the previous LCD DRE is detached. The switch over is accomplished using a simple diode circuit. The LCD DRE does not loose power or glitch during the switch over. The other feature important feature allows the remainder of the network to continue to operate normally. Again, automatic termination and hot-connect of the network, together with the local battery, permits the end voting station to be removed from and reconnected to the network for curbside voting purposes.

In step P434, the voter begins voting by entering an available voting station. The LCD DRE at that station instructs the voter to enter his or her their access code. Once the voter enters the code, the LCD DRE validates the code with the JBC 102 and loads the correct ballot style, as previously assigned. The LCD DRE screen 200 displays voting instructions giving the voter operational guidance. With successful entry of the access code, the corresponding booth status LED from the group of LEDS 212 on the JBC 102 turns red indicating that the booth is in use.

The voter may begin voting after clearing the voting instruction screen. The first page of the ballot is displayed as shown in FIG. 5 with a header at the top and the election contests occupying the majority of the display area. The header area typically contains the election name, date, precinct or early voting location name and the ballot style number that the voter is voting on. The election identification information will vary with each jurisdiction and is set up by the election administration station 116 during the ballot lay out process.

In the ballot navigation of step P438, the voter scrolls through successive electronic pages of the overall ballot by interacting with the controls in area 304. Each current ballot page is presented below the election identification. This identification is retained as a common feature on all ballot pages. The current page shows the number of the current page relative to all pages, and the current page number is highlighted. As the page changes, each new current page number is correspondingly highlighted. The highlighted current page is always centered so that the other listed pages change positions.

Each page typically has many ballot elements, e.g., elements 504–510, that together identify multiple races and contests. The LCD DRE screen 300 always displays a single ballot element in a highlighted fashion, which is called the ballot focus. The ballot focus is similar to a cursor and shows the active location by identifying a complete ballot element. As discussed above, the user interface area 304 of each LCD DRE includes a set of push buttons 306-314 and a rotary input device 316, which together provide the voter with a set of dedicated functions that are used to navigate the ballot, enter selections and cast votes. The dedicated functions may be software configured to permit the following preferred group of functions:

Cast Ballot—used when the voter has finished interacting with the ballot and wishes to record his or her vote;

Next—takes the voter to the next page of the ballot;

Prev—takes the voter to the previous page of the ballot;

Help—provides the voter with operating instructions and/or signals a poll worker that assistance is requested;

Enter—when a selection is highlighted, activation causes the highlighted selection to be chosen; and Select—rotary input device 316 for moving the ballot focus.

Turning the rotary input device 316 for select purposes causes the ballot focus to move from one ballot element to the next. This method is the primary method used to navigate the ballot in step P440. Thus, the voter turns select until the selection is highlighted and presses Enter (e.g., button 314) to register a choice. The registered choice is communicated to the voter by a change in the ballot element. This change is typically a box (e., box 506) or oval that is darkened or changes color within the choice coincident with the voter having pressed Enter. When all choices for a page are registered, the voter presses Next, and the next page of the ballot is displayed with the ballot focus on the first ballot element of the next page. There are also ballot navigation elements at the beginning and end of each page. The ballot navigation elements are preferably titled "Previous Page" and "Next Page" respectively, and can be used instead of the buttons for these functions by selecting the ballot navigation element and pressing Enter. The addition of these navigation options allows the voter to cast an entire ballot by using only these two input devices. Furthermore, the voting station programming can cause the page to change automatically when all selections on a given page have been made.

This process of ballot navigation in step P440 continues until all selections have been made. The voter then presses Cast Ballot and to electronically record the ballot at JBC 102. Until the voter presses Cast Ballot, the voter is free to make any change to previously chosen selections. Using Select, Next and Prev, the voter can navigate backwards and forward through the ballot to change or review any selection. Other navigational aids are provided to assist and speed up the navigation process. For example, when a choice is made within a particular race, the choice is registered and the ballot focus moves to the next race. Also, each ballot element carries with it certain ballot logic that assists in completing the ballot correctly. Ballot logic prevents the voter from over-voting, i.e., making too many choices for a single race causing their choice not to be counted for that particular race.

As stated above, the election administration station 116 has established the titles and race/contest formats using a template. The default template displays the titles and race/contest in two columns on the LCD DRE screen. Each available option within a race has a graphical shape, such as a box or an oval, next to the selection. When the ballot focus comes to the first page, or a first view of a subsequent page, a predetermined first ballot element is highlighted. This ballot element is typically a race/contest title. When a race/contest is highlighted, instructions are displayed within the title informing the voter to press the Enter button if he or she wants to move to the next race/contest. If enter is pressed with the ballot focus on a title, the Ballot Focus will move to the next race/contest title on the page. If the voter turns the wheel of rotary input device 316, the ballot focus moves to the first option within the race. Continuing to actuate the rotary input device 316 will sequence the ballot focus through the ballot options on a particular page.

Once the voter makes a selection for a particular contest, a corresponding ballot element, e.g., box 506, changes format when selected to present a different visual presentation to the voter. For example, the selected ballot element changes font, becomes darkened or changes color to indicate that the option has been selected and the title and remaining options are grayed to emphasize the voter's selection. As this occurs, the ballot focus automatically moves to the title of the next race/contest.

For write-ins, ballot casting and other special instructions, pop-up widows are displayed to communicate with the voter. Each pop-up window has options available consummate with the type of action required by the voter.

Ballot Images

As explained above, the voter is free to change any and all selections by moving the ballot focus to the desired option and pressing Select until such time as the Cast Ballot button is pressed. In a vote for one option the LCD DRE will de-select the previous choice and update with the new selection. If more than one selection is required for a race and the voter attempts to change a selection, instructions are given to the voter that they must first de-select an option before a different one may be selected. The LCD DRE will not allow the voter to vote for too many candidates (over vote). When finished, the voter presses the Cast Ballot button, the display goes blank, and the display next displays a message indicating the vote has been recorded. This message is displayed for several seconds while the LCD DRE is made ready for the next voter The voting "logic" that is used to assist the voter in completing their ballot correctly is applied at the visual level so that what the voter sees or hears is exactly what is recorded. Once the voter presses the Cast Ballot button, his or her votes are recorded, and it is no longer possible to change selections that have been made on any ballot elements.

Visual Vote Verification

Process step P442 is a preferred but optional step that assures the information presented to the voter at the voting station is the information that is being recorded as a cast vote record. The conventional process of displaying the cast vote record on the LCD DRE screen 300 is to format, save and transmit the data in a high level language. The last step that is performed prior to displaying the ballot page is delivering the high level code to an Integrated Circuit (IC), which is called an LCD controller. The LCD controller's function is to interpret the high level code and transform the information into a format that is able to drive the individual elements of the LCD in a conventional manner. These individual elements are called pixels, and each pixel represents a single dot on the LCD screen 300. In the preferred embodiment, the LCD screen 300 is made up of 480,000 pixels in a 600×800 matrix. In the preferred embodiment, each pixel requires up to 8 bits of computer code to allow the pixel to be displayed in any of 256 different colors. In cases where candidate photographs or more complex graphics are required, each pixel may require up to 24 bits or more or computer code, e.g., eight bits for each primary color, e.g., red, blue, and green, to control its output (i.e., color, grayscale, etc.). The LCD controller takes the high level code and outputs 3,840,000 bits of information at a time, which, in preferred embodiments for example, equals one screen of data.

When a page is displayed for the first time during the voting process to the voter, the image as viewed by the voter is the same image that was created by software at the election administration station 116 when the election official laid out the ballot. This initial image is the base image data from which voting on each page begins. When the voter makes a selection, the LCD DRE digital core electronics are signaled and a screen update is initiated. The LCD DRE electronics decodes the input and sends a new batch of high-level code to the LCD controller corresponding to the modified base image data, which is modified by being "AND'ed" with the updated image. In preferred embodiments, only the modified portion or the selected field of affected LCD screen memory is updated. This new batch of high-level code represents the action indicated by the voter through the activation of the user interface.

The particular user input is stored in temporary memory along with positional information that is used to identify the particular race flag corresponding to the selection. The sum of this data creates the ballot image. The LCD controller outputs the updated set of bits and the updated image is displayed. The updated image shows the base image with the voter's selection being visually distinguished to provide visual feedback to the voter indicating that a particular selection is made. Distinction of the voter's selection can be accomplished through several means, including, but not limited to, inverse video, bolded fonts, change in font size, font style, color, etc. The above process continues until the voter has made all of his or her selections for that page. The voter then selects the "next page" or "previous page" function of the LCD DRE. Once another page is selected, an appropriate new page is displayed with a corresponding new base image, and the process begins again.

The act of selecting another page initiates a novel feature of the present invention. When the "next", "previous", or "cast ballot" input is selected, the LCD DRE electronics perform a visual vote verification in step P442. The LCD DRE verifies that the record of the user-selected inputs is identical to those that are distinguished to the voter by visual means. This process step provides a means to verify, with each turn of the electronic page, that what the LCD DRE has recorded the voter's selections as an exact match with the visual distinctions that are shown to the voter. The means by which this is accomplished is by comparing the bit map of the base image data for a particular page and comparing it to the bit map of the last update of the LCD prior to turning the page. The voter selections are apparent as differences from the base image. The selections are compared to digital memory representing selections that the voter has made, and the voter is prompted to enter a vote again in the event that there are discrepancies between the visual display of the voting record and the digital cast vote record.

The process step P444 of capturing or generating the ballot image is performed once visual verification is complete. The LCD DRE maintains the voter's selections in temporary memory until the voter activates the Cast Ballot button. At that point, the JBC 102 moves the voter's selections, or the ballot image, into nonvolatile memory for storage in step P444. This memory storage is redundant in the sense that duplicate entries are made to memory within JBC 102 and to memory in the mobile ballot box 112. After the ballot image storage has been verified by the JBC 102, the voter receives a confirmation that his or her vote has been recorded.

Preferred Processing for Ballot Image Storage

In step P444, the cast vote is preferably but optionally stored randomly in memory to add to the voter's anonymity. The mobile ballot box 112 is the primary storage location, and the JBC 112 provides a backup copy. A third copy of the ballot image is stored in the LCD DREs, and a fourth copy may be transmitted to the election administration station 116 or election headquarters using the telecommunications connection 114. When each vote is stored, it is kept intact so that an exact electronic replica of the cast vote can be reproduced, if necessary. Additional information that is stored with each ballot image includes ballot style information, each selected and non-selected option, write-in data and challenged retrieval number, if required.

As shown in FIG. 6, the ballot images are stored to preclude any determination of which order the votes were cast, and this is accomplished through the use of a random multiple stack register 600—in this case a dual stack register. This storage is accomplished by storing each new cast vote record comprising a ballot image from volatile memory 602 in one of two stacks 604 and 606 of nonvolatile memory 608. A random generator 610 is used to determine which of stacks 604 and 606 will receive the stored ballot image. The stacks 604 and 606 have a common starting point 612 in memory. Stack 604 grows up in memory and stack 606 grows down in memory. The starting point 612 for storage of the first ballot image is determined randomly by selecting an address near the middle of the allocated memory space 612. Because the starting point 612 is randomly selected and no record of this starting point is maintained, the beginning of the list cannot be determined when data is viewed after the election. It is not necessary that the stacks 604 and 606 grow from a single starting point 612, and additional random stacks may be created in a similar fashion. The dual stack configuration that is shown in FIG. 6 represents the most efficient use of memory for these random stack assignments and, consequently, is much preferred for situations where limited memory is available in an embedded system.

Another system implementation for randomizing the order in which ballot images appear in memory is to use a system, such as a number-generating algorithm, for creating voter codes to address memory blocks that are large enough to store a single ballot image. Randomizing the equation that is used during each election, or by randomizing the coefficients of such an equation, assures that the exact placement of ballot images in memory would be very difficult to decode after the election. The equation or algorithm to generate these codes preferably assures that each voter code is unique for a particular polling place, which assures there is no possibility of two ballot images being assigned the same place in memory.

Yet another system for randomization of stored ballot images includes a two-part process. The first part of the process includes the generation of a random number, e.g., from the low order two bits of a clock function. This random number is used as the bottom bits of a memory address within a certain space. A check is then made to see if a ballot image already exists at this location in memory. If not, then the ballot image is placed at this random address. If a ballot image already exists at this location, another random number is generated and the process loops until the ballot image is stored.

Private and Public Counters

According to step P446, a public counter is incremented with each vote that is cast, and this counter cannot be reset while the polls are open. The public counters are reset at headquarters before the equipment is deployed for an election. The public counter is the cumulative number of votes cast in the precinct and is displayed on the JBC display 200. The counter is visible to all election officials while the equipment is powered on. Each LCD DRE maintains a public counter internally. This value is part of the Audit Log, but it is not displayed to the voter.

A private counter records the accumulative count for votes that are cast on a particular JBC 102 for the life of the device. The total includes election and test ballots. The private counter increments only by the Cast Ballot switch activation and can never be reset. The JBC 102 has a private counter that tracks the cumulative number of ballots it has processed.

Closing the Polls

When it is time for the poll worker to close the polls, a defined function softkey 206 is used to cause the JBC 102 to initiate the closing process in step P448. Several sub steps are used to protect the integrity of the election information. First, the LCD DREs are frozen to prevent them from being accessed again for voting. The final public and private counter of the JBC 102, the time of closing, and the electronic serial numbers of all devices and ballot types are stored and copied to the mobile ballot box 112. System diagnostics are run as part of the closing sequence to diagnose any problems that may have occurred during the voting process.

All the above steps are performed automatically by the JBC 102. The precinct voting system cannot be reopened once it is closed because the passwords and/or verification codes that are used in step P402 cannot be used a second time. The mobile ballot box 112 can now be removed using an authorized password and transported to election headquarters for a cumulative tally.

Once the mobile ballot box 112 is removed from the JBC 102, an exact copy of the data remains intact in the JBC 102 as a backup. This data is the accumulation of all votes from all of the LCD DREs that were connected to JBC 102, which can immediately provide results by the printer 212 if this capability is required by the jurisdiction. A third copy of the information is stored in each of the LCD DREs. Each LCD DRE maintains a copy of all votes cast from that LCD DRE. This stored data differs from the information stored in the JBC 102 and the mobile ballot box 112 in that it is not stored with images from the other LCD DREs.

Step P448 tests a flag setting to determine whether the polls have closed or whether voting has been suspended. If the polls remain open, then process steps P426–P446 are repeated for each new voter.

Suspended Polls

Early voting can begin as many as seventeen days in advance of Election Day. When the poll worker enters the polling place name, the mobile ballot box 112 is able to identify the location as an authorized early voting site. At these locations, the poll worker has the opportunity, according to step P450, to suspend voting at the end of the day rather than closing the polls in step P448. By virtue of a poll worker pressing the "Close Polls" function on the JBC 102 at an early voting site, the JBC 102 presents the option to the poll worker to suspend voting or to close the polls. When the suspend voting option is selected, the JBC 102 prints out the values for the public and private counters of the JBC 102, the serial numbers and public counters of each LCD DRE, the time, the date and the location. The JBC 102 writes an entry to the audit log that the unit is going into suspended voting mode. The poll worker is then instructed to power down the precinct voting system 100 by unplugging the unit. Once the unit is powered down, the mobile ballot box 112 is removed and a new one is installed. At this point, the precinct voting system 100 may be disassembled and the equipment secured for the night.

When suspended voting is to resume the next day, the network must be configured as if the equipment were being set up for the first time in the election according to step P402. Once the JBC 102 powers up, it checks the audit log and acknowledges that it was in suspend mode. It then verifies that a new mobile ballot box 112 has been installed and that is contains no cast vote records. The new mobile ballot box contains the same electronic ballot data and all verifications performed. The only difference between being powered up at the beginning of the election and recovering from suspend mode is that the JBC 102 allows votes to be stored in its internal memory and in the LCD DREs. The JBC 102 prints out a report that is identical to the printout prior to entering suspend mode. The values contained in the pre- and post- suspend mode are compared by the poll worker and given a match, voting may now continue.

On the final day of early voting, the close polls function is selected and, instead of selecting the suspend option, the poll worker selects "Close Polls" and follows the process as described above.

Results Summary

Report printing from the JBC printer 212 is enabled in step P452 after the polls are closed. The JBC 102 is able to produce a results summary that gives the number of votes for each contest, race, and issue. The results are produced on a precinct basis and are not available at early voting sites.

The results summary can be transmitted via telecommunications link 114 to headquarters through an external modem attached to the serial port on the JBC 102. The JBC 102 has a menu option that allows the user to initiate the transmission. The dial-up phone number and modem settings are set by the mobile ballot box 112, and the poll worker merely authorizes the transmission. A status of the transmission is provided during the process and the user is notified when the transmission is complete. The JBC 102 prints out a confirmation of a successful transmission with the date, time and other details about the location.

Audit Log

According to step P454, the precinct voting system 100 maintains a complete electronic audit trail or audit log of all events that occur during the voting process P400. This audit log is maintained from the point that the JBC 102 receives power to begin the voting process. Beginning with the results of the power on self-test through to the time that power was removed, any event that changes the state of the system or data is recorded with a time and date stamp. The detail that is contained in the resulting audit log is very specific and includes the time and date that each vote was cast (but not the ballot itself). A complete network audit log is saved both in the internal memory of the JBC 102 and in the mobile ballot box 112 as events occur. Each LCD DRE that is connected to the network maintains its own separate audit log of events that are specific to that LCD DRE. All audit log entries are preferably saved in FLASH memory and, consequently, are unaffected by power cycling. A printed record of the audit log is optionally provided in step P452.

The foregoing discussion provides the preferred embodiments and those skilled in the art will recognize that minor changes to the concepts that have bee described may be made without departing from the scope and spirit of the invention. The inventors, accordingly, state their invention to rely upon the Doctrine of Equivalents to protect their full rights in the invention.

We claim:

1. A precinct electronic voting system for use in elections, comprising:

a controller configured with an interactive menu system permitting a poll worker to preside over an election;

electronic ballot information stored on said system;

at least one voting station coupled with said controller to form a network that is physically configured to reside at a precinct location, said voting station having an electronically configurable display for presenting indicia representative of said electronic ballot information to voters;

a member selected from the group consisting of a mobile memory and a telecommunications connection for transferring said electronic ballot information between an election administration station and said controller; and program logic resident at the controller for selecting and disseminating portions of the electronic ballot information between the controller and the voting station on a voter-specific basis to facilitate cooperable interaction between the voting station and the electronically configurable display, the cooperable interaction being directed by the program logic to assist the voter in casting votes during the election.

2. The electronic voting system as set forth in claim 1, wherein said electronically configurable display is a liquid crystal display.

3. The electronic voting system as set forth in claim 1, wherein said voting station is programmed with voter logic for navigating through said indicia to present a voter with a ballot focus comprising a single selected ballot element.

4. The electronic voting system as set forth in claim 3, wherein the ballot focus changes format for visual presentation to the voter when selected.

5. The electronic voting system as set forth in claim 4, wherein said ballot focus is selected from the group consisting of darkened ballot elements, ballot elements having a changed font, and ballot elements having a changed color.

6. The electronic voting system as set forth in claim 1, wherein said controller contains machine instructions permitting interactive configuration of said voting station prior to opening of polls for election purposes, said interactive configuration including manipulation of user input devices by a poll worker in said voting stations as prompted by said controller.

7. The electronic voting system as set forth in claim 1, wherein said electronic ballot information has a data structure formed as a hierarchy of pages.

8. The electronic voting system as set forth in claim 1, wherein said electronic ballot information comprises a plurality of different ballot styles and said program logic includes logic for assigning a selected ballot style to a particular voter according to eligibility to vote in a predetermined selection of elections.

9. The electronic voting system as set forth in claim 1, wherein said controller includes a voter access code generator for voter entry at said voting station, said voter access code being unique on said system during a single election.

10. The electronic voting system as set forth in claim 9, wherein said voter access code generator generates a voter access code that is substantially dissimilar to other voter access codes currently assigned for use on said system to prevent voters from mistakenly entering an erroneous voter access code.

11. The electronic voting system as set forth in claim 1, wherein said voting station is selectively configured with a disabled access unit.

12. The electronic voting system as set forth in claim 11, wherein said disabled access unit includes audio system for replicating said electronic ballot information and adaptors configured for coupling with special controls for physically challenged persons.

13. The electronic voting system as set forth in claim 1, wherein said voting station is configured to operate on an automated RS-485 network termination circuit permitting separation of individual voting stations from LCD DREs without interruption of network operations.

14. The electronic voting system as set forth in claim 13, wherein said automated RS-485 network termination circuit is modified to permit termination at each voting station without having a conventional network termination circuit installed in each voting station.

15. The electronic voting system as set forth in claim 1, wherein said controller is configured to permit suspended early voting sessions over a period of days prior to an actual election day.

16. The electronic voting system as set forth in claim 1 including electronic means for verifying that indicia presented on said electronically configurable display matches votes being cast and stored as a voter concludes interaction with said voting station.

17. The electronic voting system as set forth in claim 1 including program logic for storing a complete ballot image of votes that are cast by each voter.

18. The electronic voting system as set forth in claim 17, wherein said system includes a plurality of stack memory registers and the program logic is configured for selecting the stack registers for storage of ballot image data through use of a random number generator.

19. The electronic voting system as set forth in claim 17, wherein said stack memory registers have a common point of origin.

20. The electronic voting system as set forth in claim 1 including program logic for providing a complete audit trail of all poll worker entries at said controller during an election.

21. A vote recording device for use as a network component in casting ballots in an election, comprising an electronically configurable display;

program logic for receiving electronic ballot information from the network and for processing the electronic ballot information to configure the electronically configurable display to display the electronic ballot information as text, the electronic ballot information including control information that establishes links between defined ballot elements to govern ballot navigation in a predetermined way by movement of a ballot focus to indicate a selected ballot element;

a user input area including a rotary input device for voter interaction according to the control information to move the ballot focus on the electronically configurable display as a visual indicator that identifies a voter choice in the casting of ballots; and means for transmitting cast ballot information to the network.

22. The vote recording device as set forth in claim 21, wherein said electronically configurable display has a flat viewing surface.

23. The vote recording device as set forth in claim 21, wherein the rotary input device cooperates with the display to present a voter with a ballot focus comprising a single selected ballot element.

24. The vote recording device as set forth in claim 23, wherein the ballot focus changes format for visual presentation to the voter when selected.

25. The vote recording device as set forth in claim 24, wherein said ballot focus is selected from the group consisting of darkened ballot elements, ballot elements having a changed font, and ballot elements having a changed color.

26. The vote recording device as set forth in claim 21, wherein said electronic ballot information has a data structure formed as a hierarchy of pages, and navigation through the pages is controlled locally at the vote recording device.

27. The vote recording device as set forth in claim 21, wherein said voting station is selectively configured with a disabled access unit.

28. The vote recording device as set forth in claim 27, wherein said disabled access unit includes program logic for replicating said electronic ballot information in non-textual fashion and means for coupling with special controls for physically challenged persons.

29. The vote recording device as set forth in claim 21, wherein said voting station is configured to operate on an automated RS-485 network termination circuit permitting separation of individual voting stations from LCD DREs without interruption of network operations.

30. The vote recording device as set forth in claim 29, wherein said automated RS-485 network termination circuit is modified to permit termination at the vote recording device.

31. The vote recording device as set forth in claim 21 including a charge coupled device operable for verifying that indicia presented on said electronically configurable display matches votes being cast and stored as a voter concludes interaction with said voting station.

32. The vote recording device as set forth in claim 21 including a selectively removable protective shield covering the electronically configurable screen.

* * * * *